US005478262A

United States Patent [19]

Yamanashi et al.

[11] Patent Number: 5,478,262

[45] Date of Patent: Dec. 26, 1995

[54] CONNECTOR WITH A TERMINAL LOCKING MEANS

[75] Inventors: Makoto Yamanashi; Takahiro Sano, both of Shizuoka, Japan

[73] Assignee: Yazaki Corporation, Tokyo, Japan

[21] Appl. No.: 311,055

[22] Filed: Sep. 23, 1994

[30] Foreign Application Priority Data

Sep. 24, 1993 [JP] Japan ..... 5-237735

[51] Int. Cl.[6] ..... H01R 13/436

[52] U.S. Cl. ..... 439/752

[58] Field of Search ..... 439/752

[56] References Cited

U.S. PATENT DOCUMENTS 4,867,712 9/1989 Kato et al. ..... 439/752

4,915,654 4/1990 Zinn ..... 439/752

5,326,287 7/1994 Hamakita et al. ..... 439/752

*Primary Examiner*—Gary F. Paumen

*Attorney, Agent, or Firm*—Armstrong, Westerman, Hattori, McLeland & Naughton

[57] ABSTRACT

The connector with a terminal locking means of this invention eliminates difficulty in terminal insertion work due to warping of the terminal locking means and to gaps between it and the housing, thus assuring smooth insertion of terminals and eliminating their plays and noise. The connector with a terminal locking means is characterized in that terminal guide surfaces are formed on the facing surfaces of the parallel wall pieces of the terminal locking means at locations between the terminal locking portions and that the terminal guide surfaces have their ends tapered in the direction of terminal insertion and removal. The wall pieces are also provided with a plurality of play prevention ribs on the outer surfaces thereof.

3 Claims, 13 Drawing Sheets

CONNECTOR WITH A TERMINAL LOCKING MEANS

BACKGROUND OF THE INVENTION

1. Field of the Invention

The present invention relates to a connector with a terminal locking means which is mounted from a circumferential wall of the connector housing in a direction perpendicular to a terminal accommodating chamber.

2. Description of the Prior Art

In FIG. 9, designated A is a male connector housing, B a terminal locking means, and C a female terminal. The male connector housing A and the terminal locking means B are made of a synthetic resin insulating material.

The connector housing A has a plurality of horizontally arranged terminal accommodating chambers 1 formed therein. An upper circumferential exterior wall $A_1$ is provided with a locking arm 2 that engages with a female connector housing not shown. One of side circumferential walls $A_2$ is formed with an opening 3 at the middle portion thereof, as shown in FIG. 10 to 12, and is also formed with a hollow portion 4 that communicates with the opening 3 and passes through the terminal accommodating chambers 1. That is, the hollow portion 4 is formed as a small opening that pierces through the upper and lower portion of each partition wall 1*a* formed between the terminal accommodating chambers 1.

The terminal locking means B, in the example case shown, is shaped like a letter U in cross section. It consists of a cover portion 6 that covers the opening 3 in the side circumferential wall $A_2$ and a pair of facing wall pieces 7, 7 provided to the cover portions that are inserted into the small openings or hollow portions 4. The wall pieces 7, 7 have a plurality of terminal locking portions 8 formed at their facing surfaces that engage with locking pieces 15 (described later) of the female terminals C. The wall piece 7 has a preliminary locking projection 9 formed at its free end on the rear side, and the cover portion 6 has final locking projections 10 formed at the upper and lower ends on both front and rear sides.

In the connector housing A is provided a preliminary engagement portion 11 that engages with the preliminary locking projection 9 of the terminal locking means B, as shown in FIG. 12. The inner edge of the opening 3 is formed with a final engagement portion 12 that engages with the final locking projection 10, as shown in FIG. 11.

The preliminary engagement portion 11 engages with the preliminary locking projection 9 to temporarily stop the terminal locking means B when the terminal locking means B is inserted into the connector housing A through the hollow portions 4. As shown in FIG. 13, the preliminary engagement portion 11 stops the terminal locking means B in such a way that the terminal locking portions 8 are held outside the terminal accommodating chambers 1 to allow insertion and drawing out of the female terminals C. The terminal locking means 8 at this stage is in a preliminary lock position.

The final engagement portion 12 engages with the final locking projection 10 to firmly lock the terminal locking means B when the terminal locking means B is further inserted into the connector housing A from the preliminary lock position. When the terminal locking means B is locked by the final engagement portion 12, i.e., when it is in a final lock position, the terminal locking portions 8 engage with the locking pieces 15 of the female terminals C, preventing the backward slip-off of the terminals.

With the terminal locking means B at the preliminary lock position, because the terminal locking portions 8 of the wall pieces 7, 7 are outside the terminal accommodating chambers 1, the female terminals C can be inserted or withdrawn from the rear side of the connector housing A.

When at this preliminary lock position the female terminal C is inserted into the terminal accommodating chamber 1, a resilient locking arm 5 inside the terminal accommodating chamber 1 engages in a locking hole 14 in a base portion 13 of an electric contact portion $C_1$ of the terminal C, as shown in FIG. 6, effecting a preliminary locking of the terminal.

In this state, when the terminal locking means B is further moved to the final lock position, the terminal locking portions 8, 8 of the wall pieces 7, 7 located on the upper and lower sides of the female terminal C are situated behind the locking piece 15 of the electric contact portion $C_1$ to engage it, thus effecting a double locking of the female terminal C.

In the above-mentioned construction, the wall pieces 7 of the terminal locking means B are made of relatively thin elongate plates and thus tend to warp upwardly or downwardly. As shown by the two-dot line in FIG. 10, the wall pieces 7 easily deflect particularly inwardly and, at the preliminary lock position of the terminal locking means B in FIG. 13, the free ends of the wall pieces 7 deflect into the terminal accommodating chamber 1 at the inmost part of the chamber.

Considering such warping of the wall piece 7 in facilitating its easy insertion into the connector housing A, the dimension of the hollow portion 4 is set sufficiently larger than the thickness of the wall piece 7 and the terminal locking portion 8 so that small gaps a and b remain on both sides when the wall piece 7 is not warped, as shown in FIG. 14.

When the wall pieces 7 warp inwardly as shown in FIG. 13 and 15, the wall pieces 7 deflect toward the interior of the chamber by the amount of gap a+b=c that exists between the wall piece 7 and the hollow portion 4 (or terminal accommodating chamber 1), blocking the insertion of the female terminal C. The deflection of this magnitude, however, is easily undone by the insertion pressure of the female terminal C, which expands the wall pieces 7 outwardly as shown by the arrow, assisted by the chamfered portion 7*a* at the end of the wall pieces 7*a* and the gap c.

When, however, the female terminal C is inserted slantwise, a stepped portion 16 is formed in the hollow portion 4 between the wall piece 7 and the inner wall 1*b* of the terminal accommodating chamber. The front end of the electric contact portion $C_1$ of the female terminal C abuts against the stepped portion 16, blocking the insertion of the terminal. This may result in the terminal or connector housing being damaged.

When there is no warping in the wall pieces 7, the terminal locking means B has a play because of the gap c, causing uneasy noise.

SUMMARY OF THE INVENTION

The present invention has been accomplished to overcome the above-mentioned problem and its primary objective is to provide a connector having a terminal locking means, which prevents the abutting of the terminal against the connector housing due to the use of the terminal locking means, and which permits smooth insertion and removal of the terminal.

Another objective is to provide a connector having a terminal locking means, which has no play between the terminal locking means and the connector housing so that there is no possibility of noise being generated while a car is traveling.

According to the first aspect of this invention, the connector with a terminal locking means of this invention comprises:

a connector housing having a plurality of terminal accommodating chambers;

an opening formed in a circumferential wall of the connector housing;

a plurality of hollow portions formed in the connector housing and passing from the opening through the terminal accommodating chambers;

a terminal locking means to be inserted into the connector housing and consisting of a cover plate portion and a plurality of parallel wall pieces extending from the cover plate portion, the parallel wall pieces being adapted to be inserted into the hollow portions formed in the connector housing;

terminal locking portions formed on the facing surfaces of the parallel wall pieces and corresponding to respective terminals inserted in the terminal accommodating chambers; and terminal guide surfaces formed on the facing surfaces of the wall pieces of the terminal locking means at locations between the terminal locking portions, the terminal guide surfaces having their ends tapered in the direction of terminal insertion and removal.

Because the inner surface of the wall piece is formed with a terminal guide surface, the stepped portion in the terminal accommodating chamber between the terminal locking means and the hollow portion for the terminal locking means is virtually eliminated, allowing the terminal to be inserted smoothly without its front end abutting against the connector housing even when the terminal is inserted slantwise.

Furthermore, because the wall piece is provided with a play prevention rib at the outer surface thereof, the gap that would otherwise be formed between the hollow portion and the terminal at the final lock position is eliminated, preventing a play and noise.

DETAILED DESCRIPTION OF PREFERRED EMBODIMENT

Figure 1:
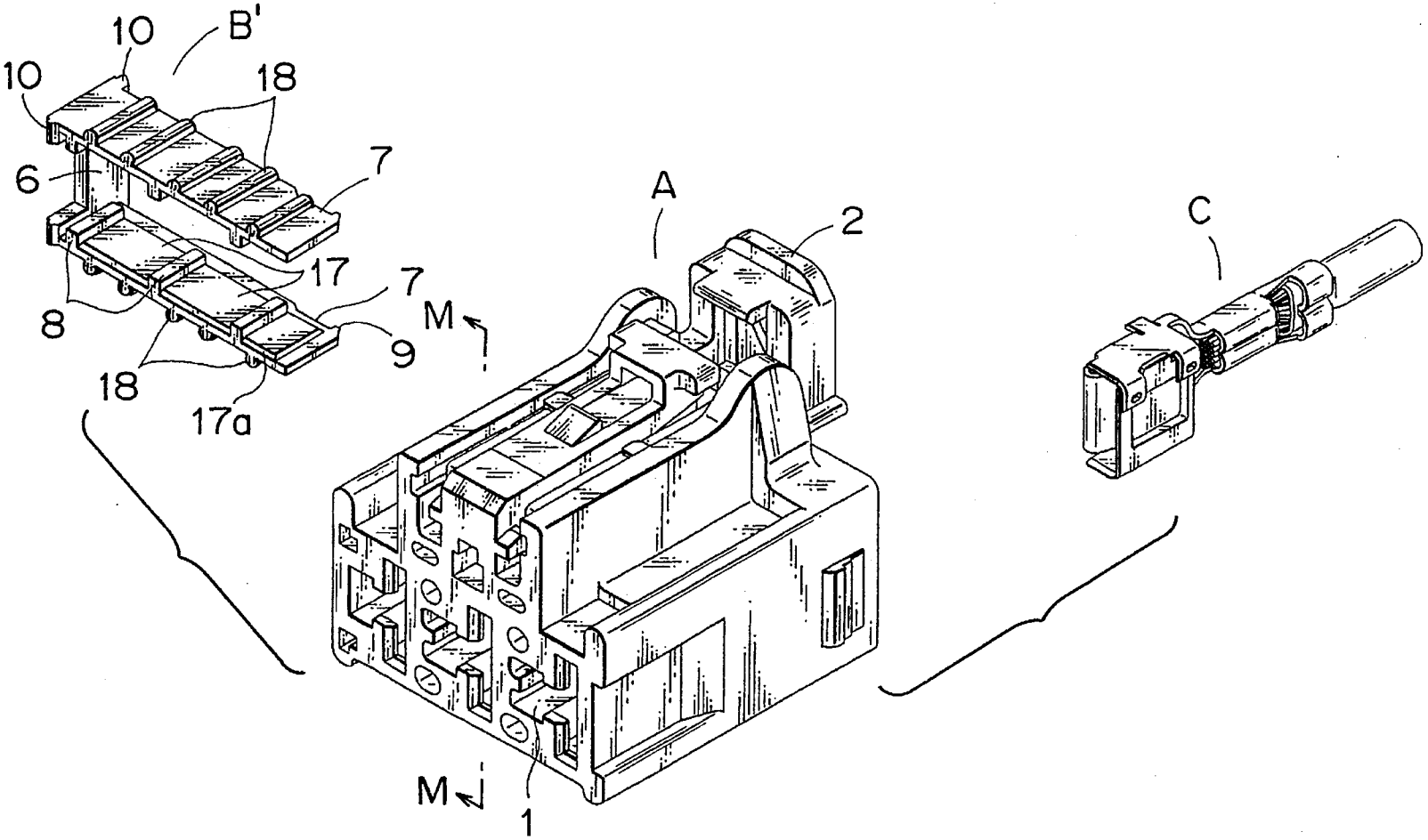
FIG. 1 is a perspective view of a connector with a terminal locking means according to this invention, with the connector housing, the terminal locking means and the terminal shown separated from each other.
Figure 2:
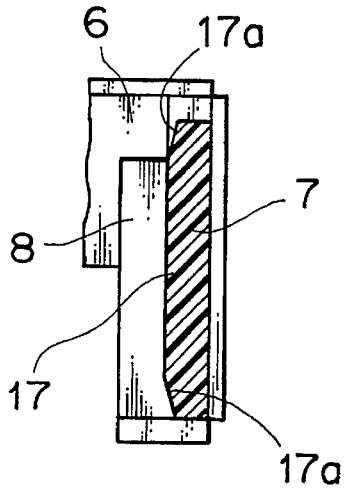
FIG. 2 is a front view of the terminal locking means of FIG. 1.
Figure 9:
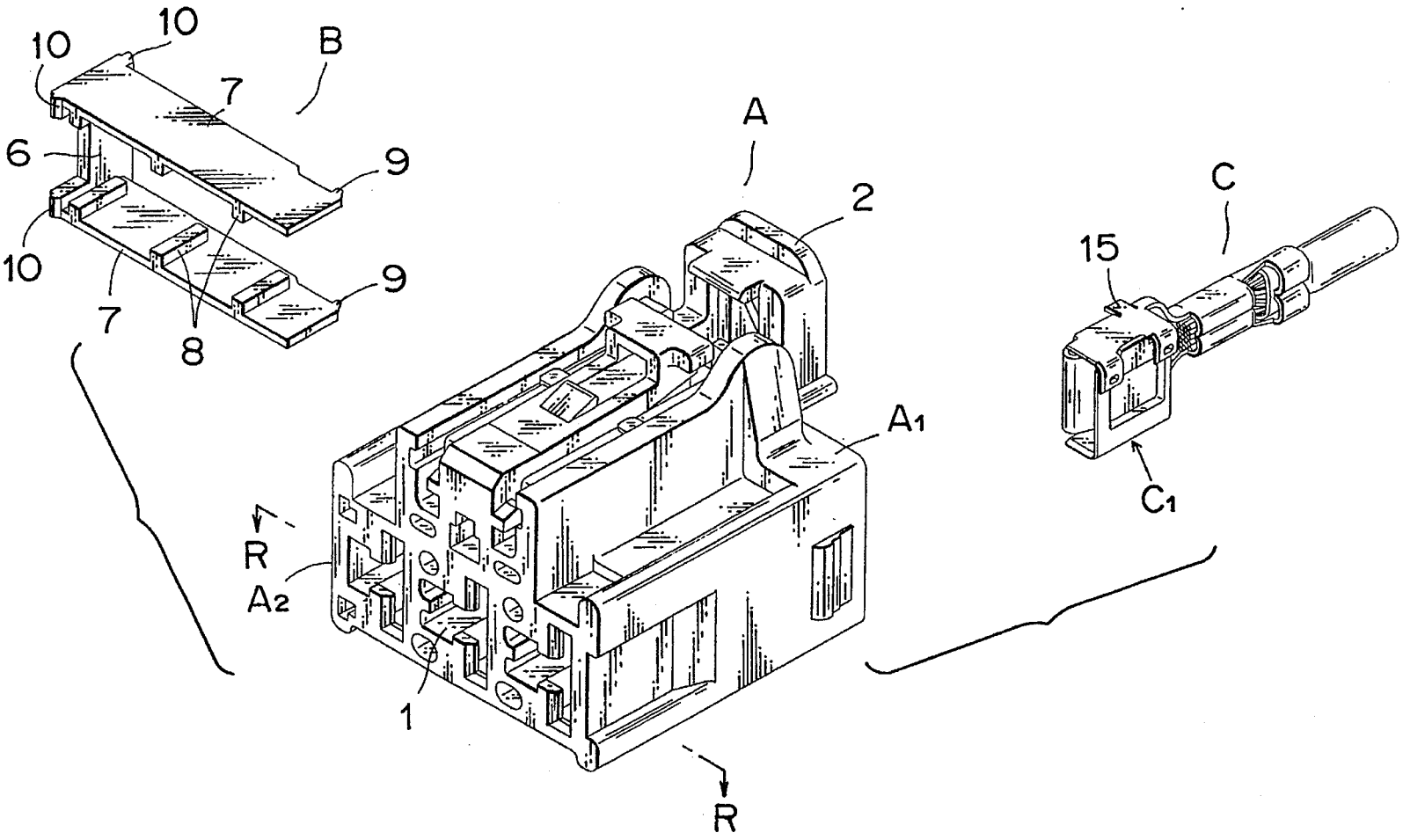
FIG. 9 PRIOR ART
FIG. 9 is a perspective view of a conventional connector having a terminal locking means, with the housing, the terminal locking means and the terminal separated from each other.
Figure 10:
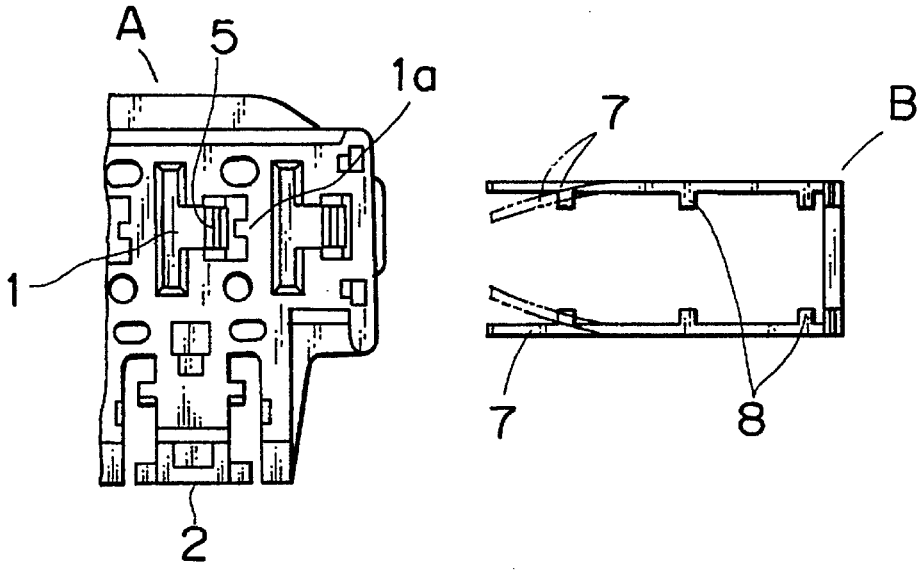
FIG. 10 PRIOR ART
FIG. 10 is a front view of the connector housing and the terminal locking means of FIG. 9.
Figure 11:
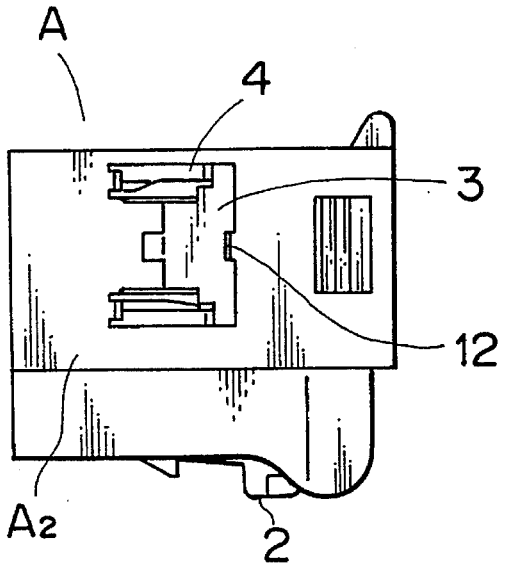
FIG. 11 PRIOR ART
FIG. 11 is a left-side view of the connector housing of FIG. 10.
Figure 12:
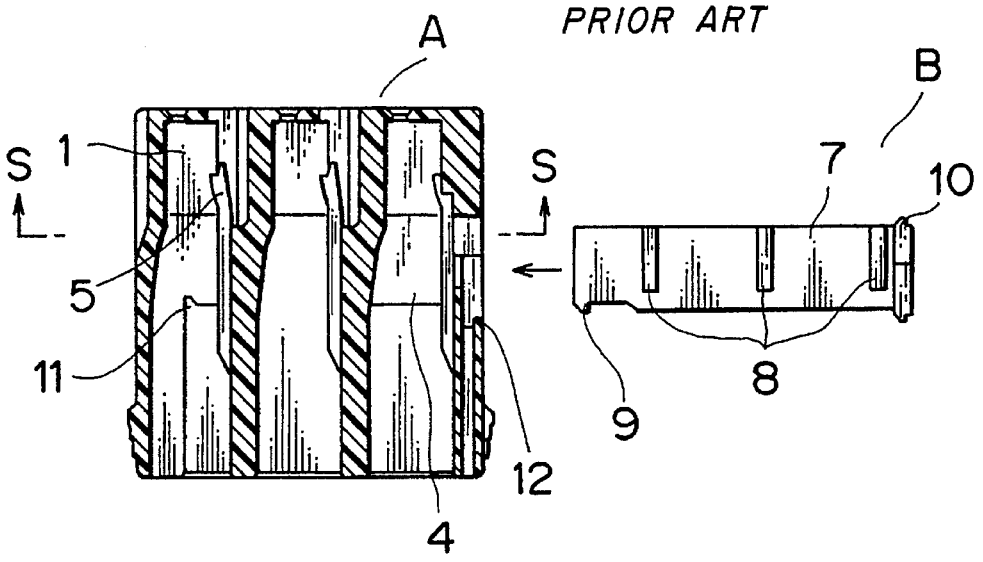
FIG. 12 PRIOR ART
FIG. 12 is a cross section taken along the line R—R of FIG. 9.
Figure 13:
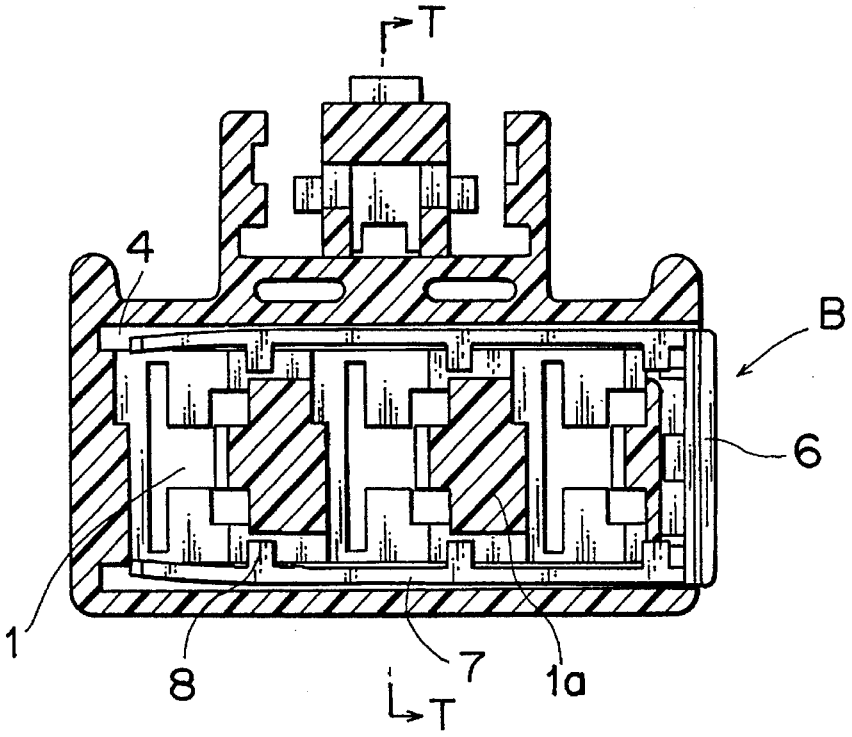
FIG. 13 PRIOR ART
FIG. 13 is a cross section taken along the line S–R of FIG. 12.
Figure 14:
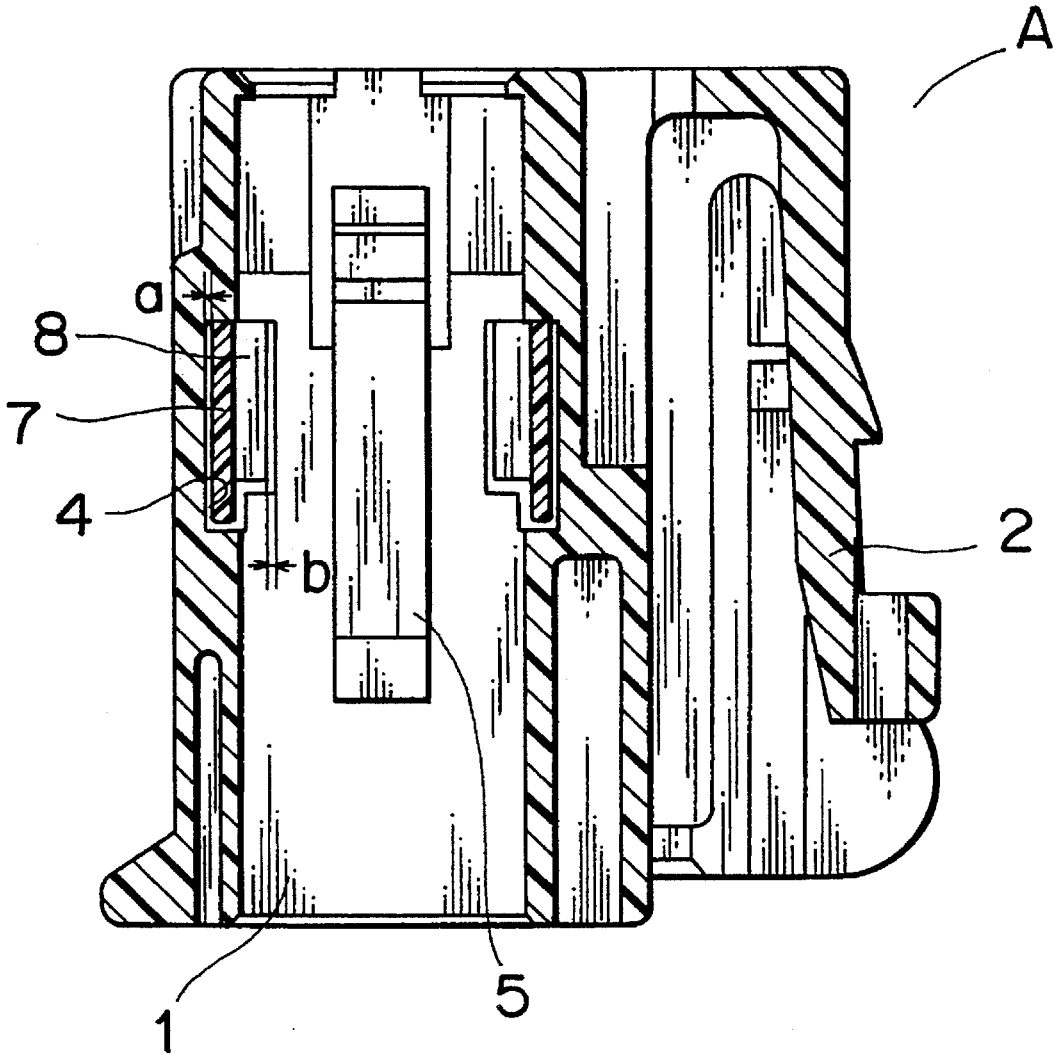
FIG. 14 PRIOR ART
FIG. 14 is a cross section taken along the line T—T of FIG. 13 showing the terminal locking means in a normal state at a preliminary lock position.
Figure 15:
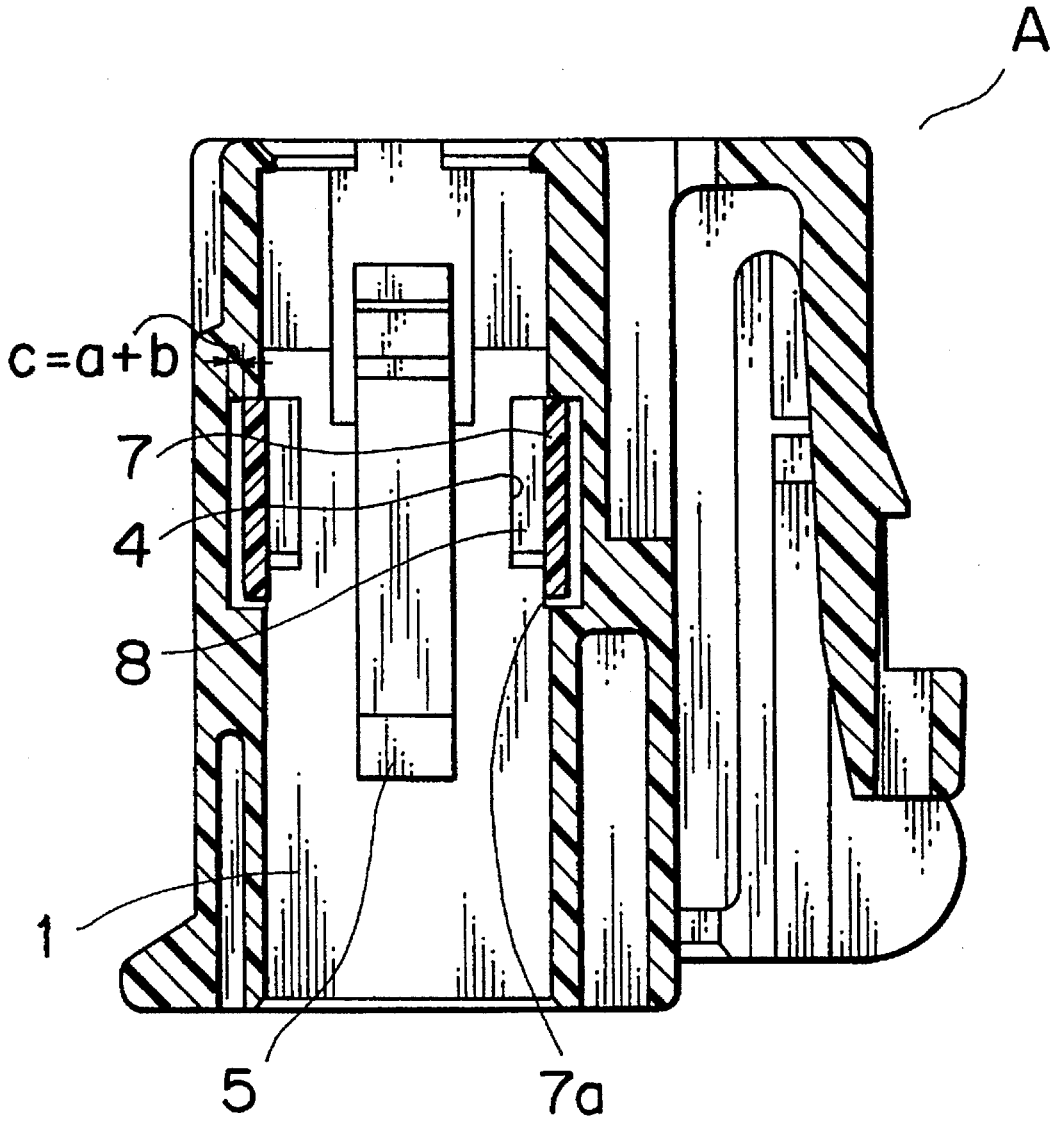
FIG. 15 PRIOR ART
FIG. 15 is a cross section taken along the line T—T of FIG. 13 showing the terminal locking means in an abnormal state at a preliminary lock position.

In FIG. 1 a male connector housing A and a female terminal C have the same structure as shown in FIG. 9. A terminal locking means B' consists of a cover plate portion 6 and a pair of parallel wall pieces 7, 7 extending from the upper and lower ends of the cover plate. The cover plate portion 6 has final locking projections 10 and the wall pieces 7 have terminal locking portions 8 and a preliminary locking projection 9. They have basically the same structure as that of the terminal locking means B of FIG. 9. In this invention, between the terminal locking portions 8, 8 on the facing surfaces of the wall pieces 7, terminal guide surfaces 17 are formed raised. On the outer surface of each wall piece 7 a plurality of play prevention ribs 18 are formed at appropriate intervals.

Figure 3:
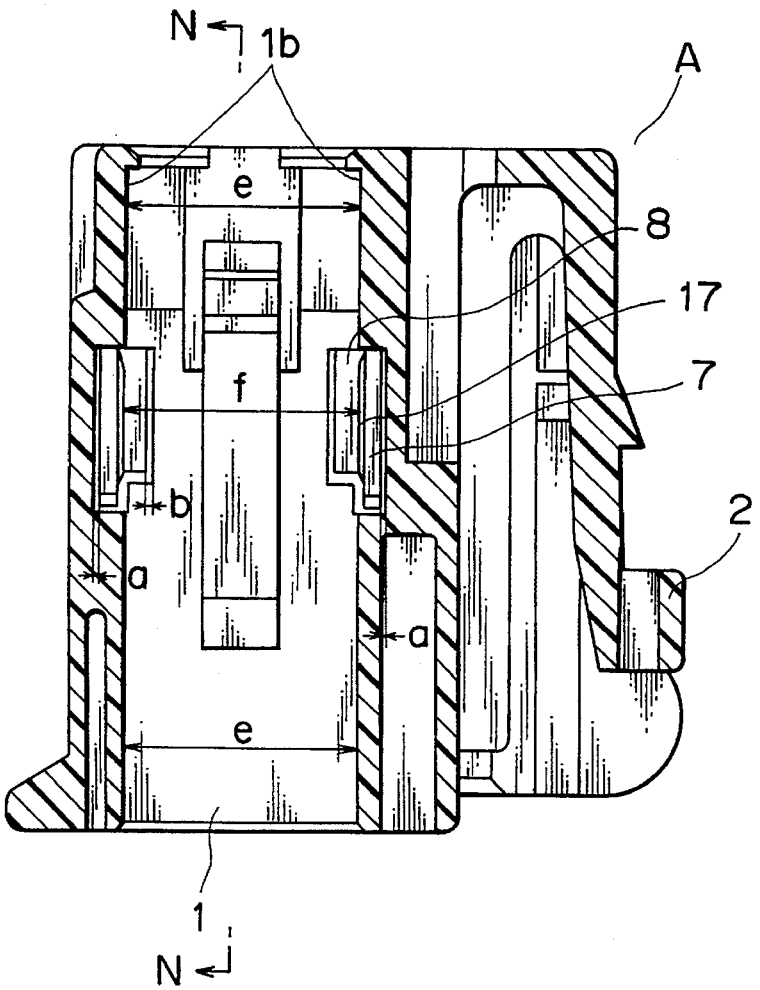
FIG. 3 is a cross section of the connector housing taken along the line M—M of FIG. 1.

The front and rear side of the terminal guide surface 17 are tapered at 17*a* for smooth guiding of the female terminal C when being inserted or drawn out. The height of the terminal guide surface 17 from the surface of the wall piece 7 should preferably be such that the dimension f between the facing terminal guide surfaces 17, 17 of the wall pieces 7, 7 in FIG. 3 satisfies the relations of $e \geqq f$ and $e \leqq f+2a$ where e is the distance between inner walls 1*b*, 1*b* of the terminal accommodating chamber 1. In this case, the standard state is that the wall piece 7 is not warped with gaps a, b formed on both sides of the wall piece 7 and the terminal locking portion 8 with respect to the hollow portion 4, as explained in FIG. 4.

The play prevention ribs 18 are formed in semicircular columns almost parallel to the direction of insertion of the female terminal C to maintain the ease with which the terminal locking means B' is inserted into the hollow portion 4. The height of the play prevention rib 18 from the surface of the wall piece 7 should preferably be equal to or less than the gap a.

Figure 4:
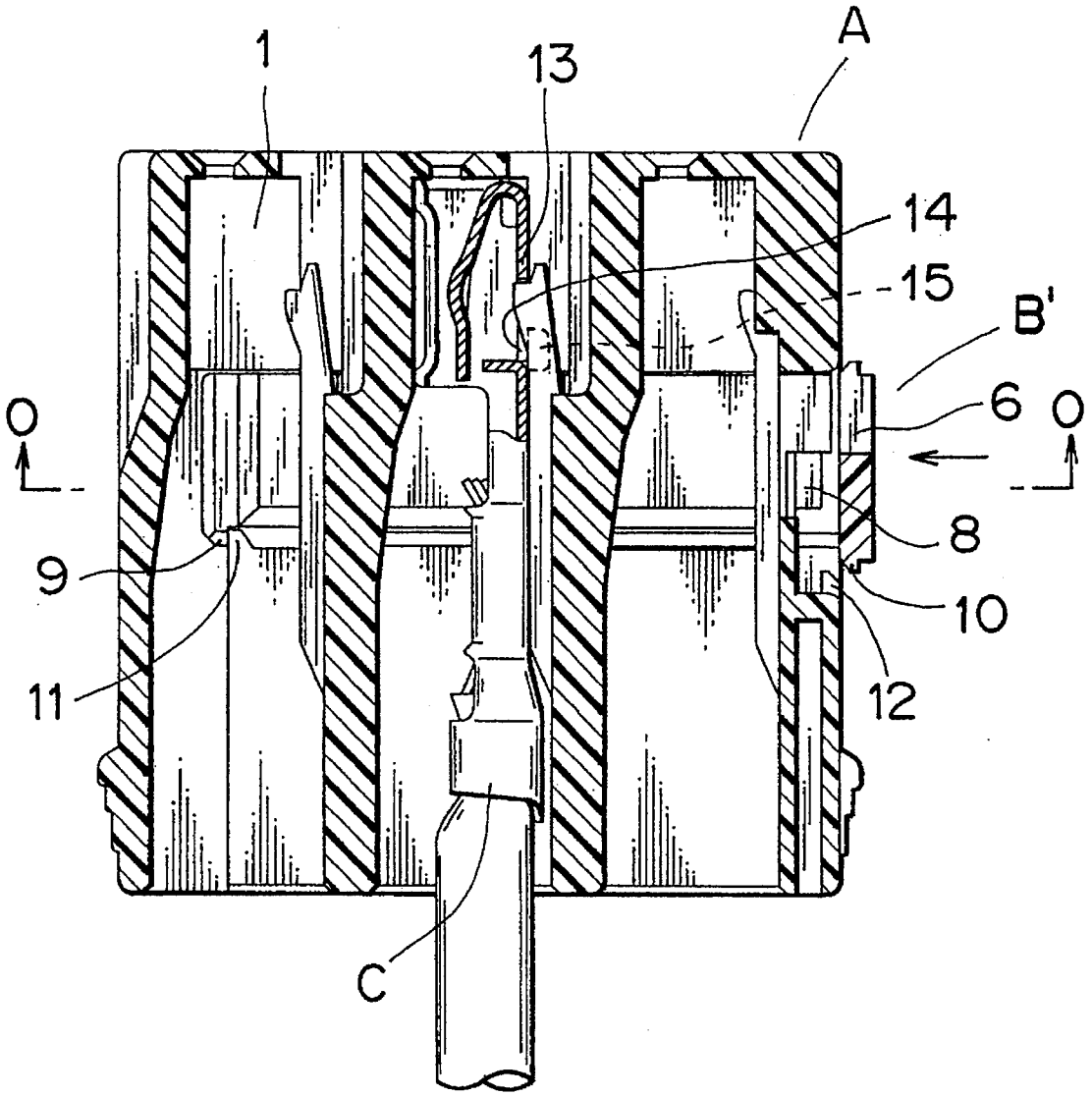
FIG. 4 is a cross section of the connector housing taken along the line N—N of FIG. 3 showing the terminal locking means in the preliminary lock position.
Figure 5:
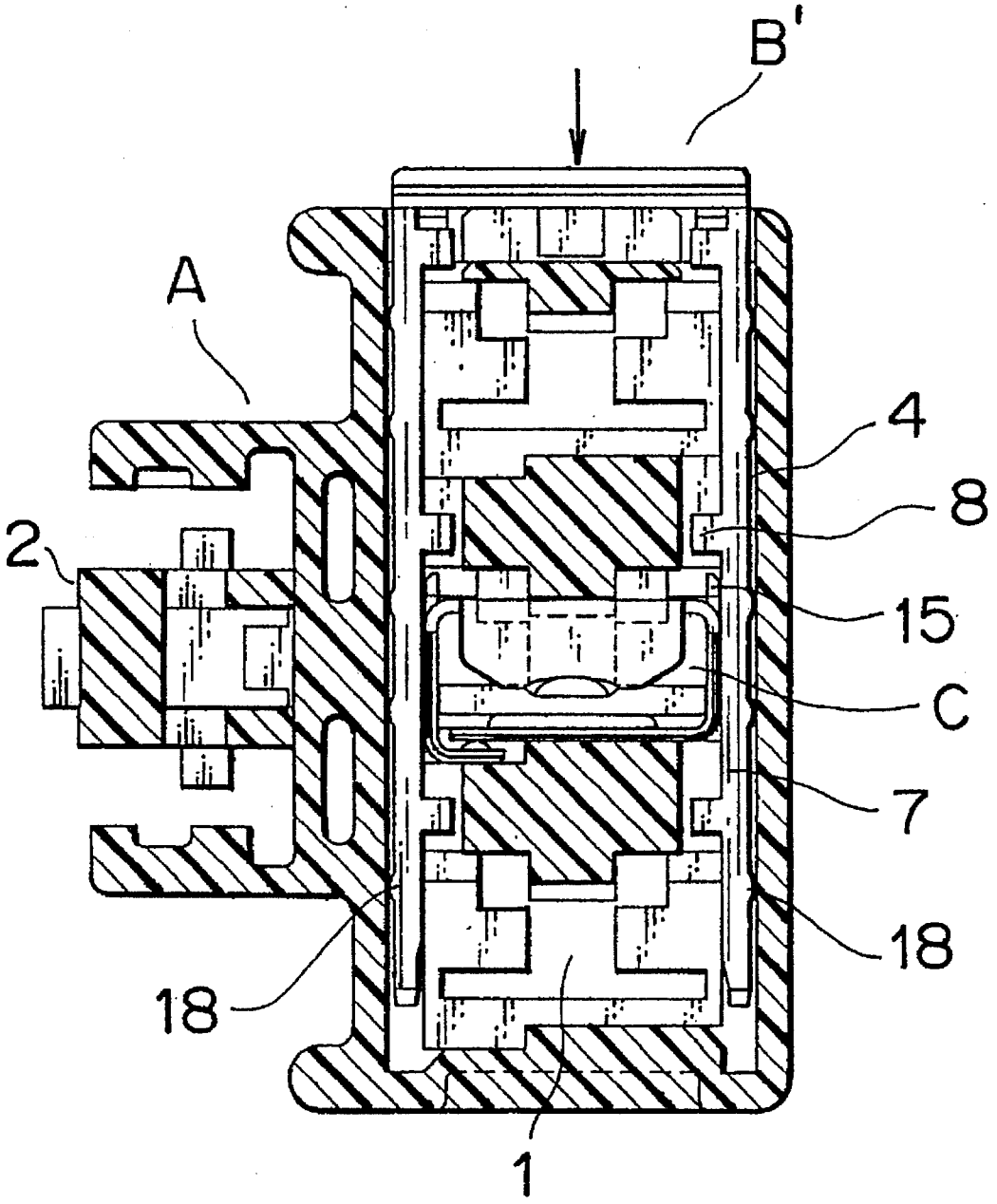
FIG. 5 is a cross section taken along the line O—O of FIG. 4.

In the above construction, as shown in FIG. 4 and 5, in the preliminary lock position where the preliminary locking projection 9 of the terminal locking means B' engages with the preliminary engagement portion 11 of the connector housing A, the terminal locking portions 8 are separated from the terminal accommodating chambers 1, so that the female terminals C can be inserted. When the terminal is inserted completely, the resilient locking arm 5 engages in the locking hole 14, effecting a primary locking of the female terminal 1.

Figure 6:
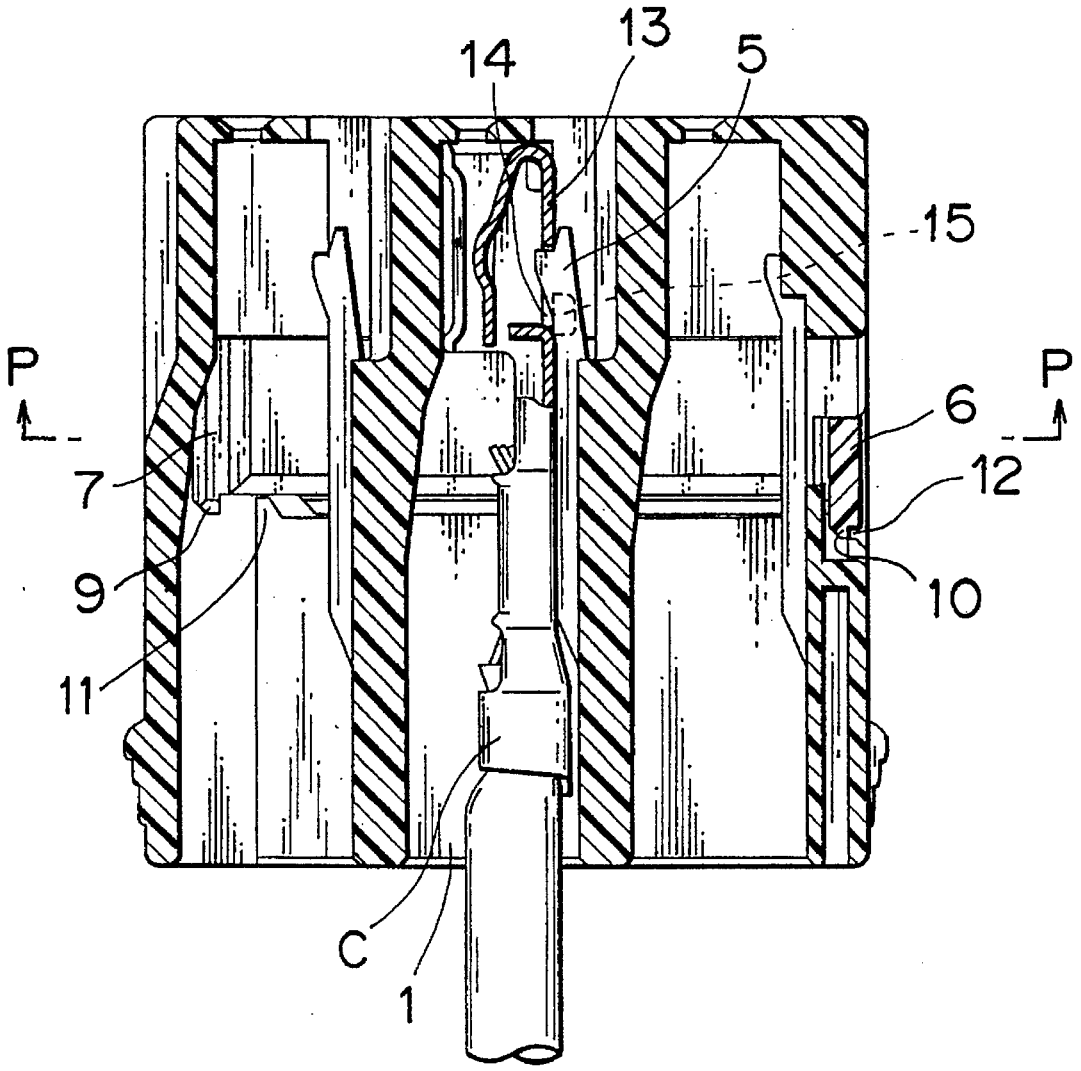
FIG. 6 is a cross section taken along the line N—N of FIG. 3 showing the terminal locking means in the final lock position.
Figure 7:
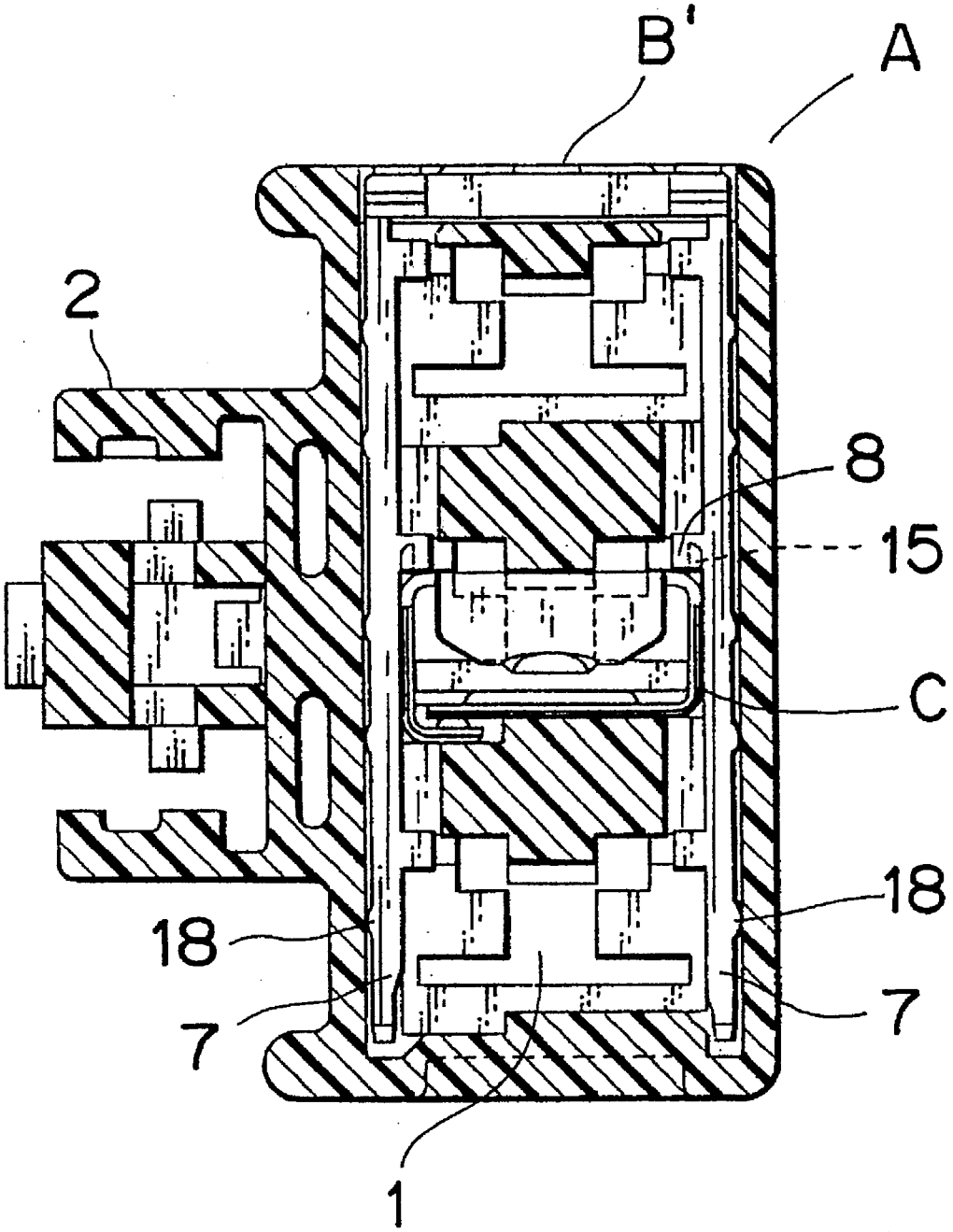
FIG. 7 is a cross section taken along the line P—P of FIG. 6.

When the terminal locking means B' is pushed from the preliminary lock position into the connector housing A to the final lock position where the final locking projections 10 engage with the final engagement portion 12, as shown in FIG. 6 and 7, the terminal locking portions 8, 8 of the wall pieces 7, 7 situated above and below the female terminals C move to the back of the locking pieces 15, 15 to prevent the female terminals C from slipping backwardly. In this way, a secondary locking of the terminal is accomplished.

Figure 8:
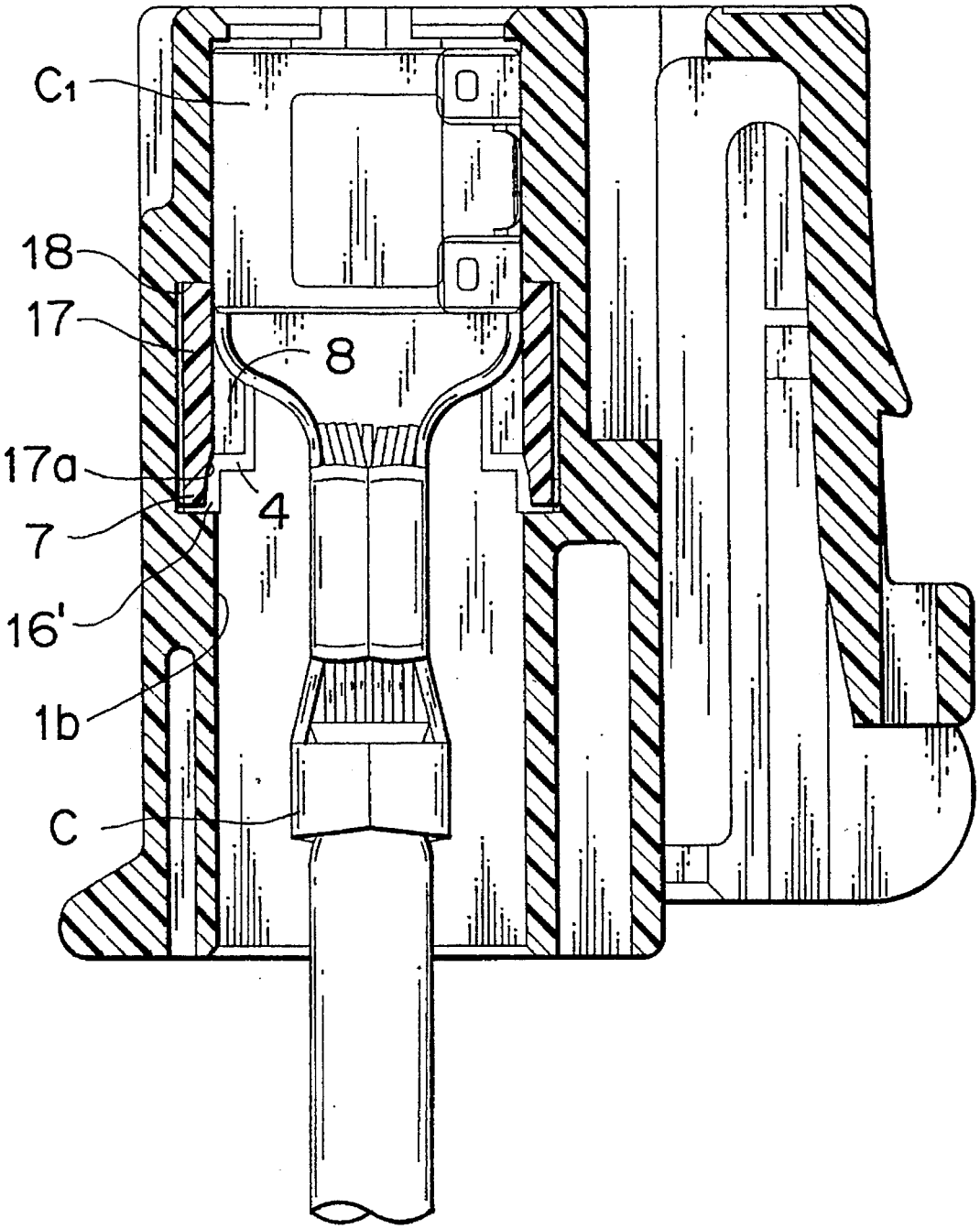
FIG. 8 is a cross section showing the terminal locking means in the final lock position engaged with a terminal lug.
Figure 16:
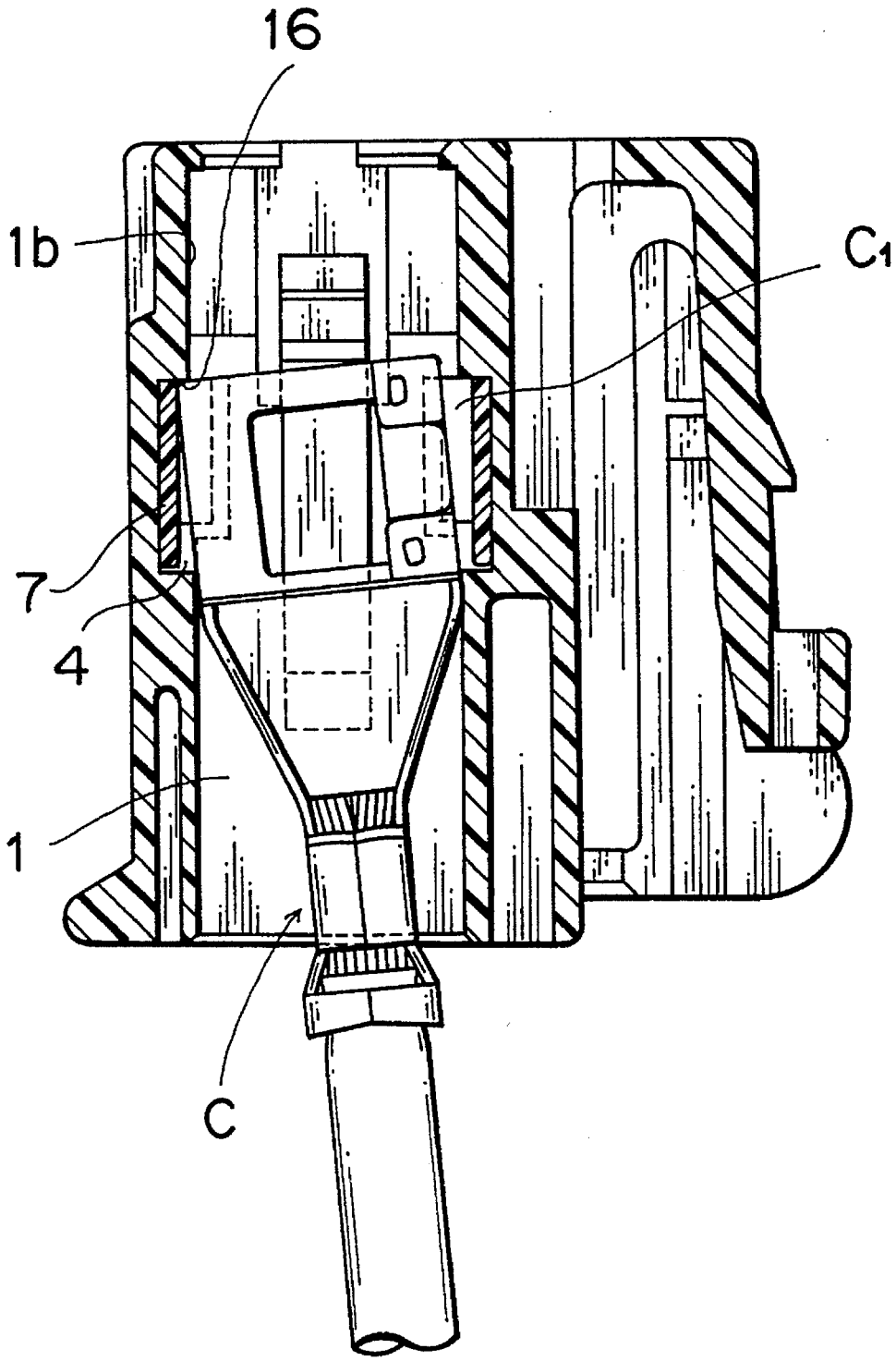
FIG. 16 PRIOR ART
FIG. 16 is a cross section showing the terminal lug being inserted slantwise.

As shown in FIG. 7 and 8, because the facing wall pieces 7, 7 of the terminal locking means B' have the play prevention ribs 18 on their back, the wall pieces 7, 7 are fitted closely to the surfaces of the hollow portions 4, eliminating plays and therefore noise. Further, in the hollow portion 4, the stepped portion 16' between the inner wall 1*b* of the terminal accommodating chamber 1 and the wall piece 7 is almost eliminated by the presence of the tapered terminal guide surface 17, so that the female terminal C, even when inserted or withdrawn slantwise as shown in FIG. 16, can be smoothly moved thereover without a blocking feel.

What is described above concerns a case where the terminal accommodating chambers 1 in the male connector housing A are arranged horizontally in a single row and where the terminal locking means B' has a pair of upper and lower wall pieces 7 that are inserted crossing the terminal accommodating chambers 1. When the terminal accommodating chambers 1 are arranged in two or more tiers, the parallel wall pieces 7 of the terminal locking means B' need only be increased in number, like comb teeth. In that case, the play prevention ribs 18 need be provided only to the outermost wall pieces, while the intermediate wall pieces are provided with the terminal guide surfaces on both upper and lower sides. Further, it is understood that a minor design change in the terminal locking means B' allows its application also to the male terminals.

The advantage of this invention is summarized as follows. Because the terminal guide surface–which has its ends tapered in the direction of terminal insertion and withdrawal is provided on the facing surfaces of the wall pieces of the terminal locking means at locations between the terminal locking portions, the terminal can be inserted or withdrawn smoothly even when there is a slight warping in the wall pieces of the terminal locking means having the terminal locking portions. Further, the provision of the play prevention ribs to the outer surface of the wall piece virtually eliminates the gap between the terminal locking means and the hollow portion in the connector housing, which in turn eliminates plays and noise.

What is claimed is:

1. A connector with a terminal locking means comprising:

a connector housing having a plurality of terminal accommodating chambers extending in the direction of terminal insertion and withdrawal;

an opening formed in an exterior wall of the connector housing;

a plurality of hollow portions formed in the connector housing and passing from the opening through the terminal accommodating chambers in a direction normal to the direction of terminal insertion and withdrawal;

a terminal locking means to be inserted into the connector housing and consisting of a cover plate portion and a plurality of parallel wall pieces extending from the cover plate portion, the parallel wall pieces being adapted to be inserted into the hollow portions formed in the connector housing;

terminal locking portions formed on the facing surfaces of the parallel wall pieces and corresponding to respective terminals inserted in the terminal accommodating chambers; and terminal guide surfaces formed on the facing surfaces of the wall pieces of the terminal locking means at locations between the terminal locking portions, the terminal guide surfaces having their ends tapered in the direction of terminal insertion and removal.

2. A connector with a terminal locking means according to claim 1, wherein the wall pieces are provided with a plurality of play prevention ribs at appropriate intervals on the outer surfaces thereof.

3. A connector with a terminal locking means according to claim 2, wherein the plurality of play prevention ribs are formed as semicircular columns substantially parallel to the direction of insertion of the terminals.

* * * * *